US007886869B2

(12) United States Patent
Bastyr et al.

(10) Patent No.: US 7,886,869 B2
(45) Date of Patent: Feb. 15, 2011

(54) ACOUSTIC WAVEGUIDE MODE CONTROLLING

(76) Inventors: Kevin Bastyr, 97 Raymond Ave., Somerville, MA (US) 02144; Hidehiko Fukushima, 5-19-12 Aoba-ku, Yokohama-Shi, Kanagawa-Ken (JP) 225-0002

( * ) Notice: Subject to any disclaimer, the term of this patent is extended or adjusted under 35 U.S.C. 154(b) by 343 days.

(21) Appl. No.: 11/852,903

(22) Filed: Sep. 27, 2007

(65) Prior Publication Data

US 2009/0084625 A1 Apr. 2, 2009

(51) Int. Cl.

| | |
|---|---|
| ***G10K 11/00*** | (2006.01) |
| ***H04R 1/02*** | (2006.01) |
| ***H04R 1/20*** | (2006.01) |
| ***H04R 1/40*** | (2006.01) |

(52) U.S. Cl. ..... 181/187; 181/192; 381/97; 381/349; 381/338

(58) Field of Classification Search ..... 181/187, 181/192; 381/349, 97, 338
See application file for complete search history.

(56) References Cited

U.S. PATENT DOCUMENTS

| | | | | |
|---|---|---|---|---|
| 4,077,023 | A * | 2/1978 | Boyd et al. | 333/147 |
| 5,150,417 | A * | 9/1992 | Stahl | 381/349 |
| 5,343,535 | A * | 8/1994 | Marshall | 381/349 |
| 5,374,124 | A * | 12/1994 | Edwards | 381/351 |
| 5,590,208 | A * | 12/1996 | Koyano et al. | 381/338 |
| 5,651,371 | A * | 7/1997 | Keefe | 600/559 |
| 5,792,072 | A * | 8/1998 | Keefe | 600/559 |
| 5,813,998 | A * | 9/1998 | Dias | 601/2 |
| 6,038,326 | A * | 3/2000 | Czerwinski | 381/340 |
| 6,278,789 | B1 * | 8/2001 | Potter | 381/338 |
| 7,133,533 | B2 * | 11/2006 | Chick et al. | 381/349 |
| 7,584,820 | B2 * | 9/2009 | Parker et al. | 181/155 |
| 7,676,047 | B2 * | 3/2010 | Aylward et al. | 381/97 |
| 2002/0085731 | A1 * | 7/2002 | Aylward | 381/349 |
| 2005/0087392 | A1 * | 4/2005 | Flanders et al. | 181/156 |
| 2007/0092096 | A1 * | 4/2007 | Litovsky | 381/349 |

FOREIGN PATENT DOCUMENTS

| | | | |
|---|---|---|---|
| DE | 1291790 | B | 4/1969 |
| EP | 0951200 | A2 | 10/1999 |
| GB | 2256343 | A | 12/1992 |
| GB | 2391739 | A | 2/2004 |
| JP | 59196690 | A | 11/1984 |
| WO | 9419915 | A1 | 9/1994 |
| WO | 0028780 | A1 | 5/2000 |

OTHER PUBLICATIONS

International Search Report and Written Opinion dated Jun. 10, 2009 for related Int. Appl. No. PCT/US2008/075686.
Ayers, R.D. et al.: "The Conical Bore in Musical Acoustics", American Journal of Physics, American Association of Physics Teachers, US, vol. 53, No. 6, Jun. 1, 1985, pp. 528-537.
International Search Report and Written Opinion dated Jun. 10, 2009 for related Int. Appl. No. PCT/US2008/075686.
International Preliminary Report on Patentability dated Jan. 26, 2010 for related Int. Appl. No. PCT/US2008/075686.

* cited by examiner

*Primary Examiner*—Elvin G Enad
*Assistant Examiner*—Christina Russell
(74) *Attorney, Agent, or Firm*—Bose Corporation

(57) ABSTRACT

An acoustic device including a first acoustic waveguide having two open ends; a second acoustic waveguide; and an acoustic driver having a first and second radiating surface positioned so that the first: radiating surface radiates into the first waveguide and the second surface radiates into the second waveguide. An acoustic device including an acoustic driver and an acoustic waveguide with two open ends. A method for making the acoustic device.

11 Claims, 18 Drawing Sheets

ACOUSTIC WAVEGUIDE MODE CONTROLLING

BACKGROUND

This disclosure relates to methods for determining placement of transducers in acoustic waveguides and to acoustic waveguide systems incorporating the method.

SUMMARY

In one aspect an apparatus includes an acoustic waveguide characterized by modes. The apparatus further includes a plurality of acoustic drivers each characterized by a diameter. The acoustic drivers are mounted in the waveguide so that at least two of the acoustic drivers are mounted at least a diameter apart and so that the acoustic drivers radiate into the waveguide so that radiation from each, acoustic driver excites one mode at a position in the waveguide at which a modal function corresponding with the one mode is non-zero, and so that the total excitation of the one mode is substantially zero. The plurality may consist of two acoustic drivers, and the magnitude of the modal function at the position of the first acoustic driver is equal to the magnitude of the. modal function at the position of the second acoustic driver and wherein the signs of the values of the modal function at the position of the first acoustic driver and the second acoustic driver are opposite. The plurality may be greater than two. The plurality of acoustic drivers may be mounted in the waveguide and radiate into the waveguide so that radiation from each acoustic driver excites another mode at a position in the waveguide at which a modal function corresponding with the another mode is non-zero and so that the total excitation of the another mode is substantially zero. The acoustic waveguide maybe an open-closed acoustic waveguide; and the acoustic drivers may be positioned according in the formula $$MF_{\frac{n\lambda}{4}} = \sin\left(\frac{n\pi}{4l}x_1\right) + \sin\left(\frac{n\pi}{4l}x_2\right) + \sin\left(\frac{n\pi}{4l}x_3\right) \ldots + \sin\left(\frac{n\pi}{4l}x_a\right) = 0,$$

where n is an odd number 3, 5, 7 , . . . , a is the number of acoustic drivers, l is the effective length of the waveguide, and $x_l \ldots x_a$ indicate the proportional distance from the open end the waveguide. The acoustic waveguide may be an open-open waveguide and the acoustic drivers maybe positioned according to the formula $$MF_{\frac{n\lambda}{2}} = \sin\left(\frac{n\pi}{2l}x_1\right) + \sin\left(\frac{n\pi}{2l}x_2\right) + \sin\left(\frac{n\pi}{2l}x_3\right) \ldots + \sin\left(\frac{n\pi}{2l}x_a\right) = 0,$$

where n is an integer greater than one, a is the number of acoustic drivers, l is the effective length of the waveguide, measured from an end, and $x_l \ldots x_a$ indicate the proportional distance from an end of the waveguide. The apparatus may further include circuitry for transmitting an audio signal to each acoustic driver, including circuitry for applying a different gain to the audio signal transmitted to at least two of the acoustic drivers. The circuitry may transmit a common audio signal to the plurality of acoustic drivers. The acoustic waveguide may be an open-closed waveguide and the acoustic drivers may be placed and the gains selected according to the formula $$MF_{\frac{n\lambda}{4}} = G_1\sin\left(\frac{n\pi}{4l}x_1\right) + G_2\sin\left(\frac{n\pi}{4l}x_2\right) + G_3\sin\left(\frac{n\pi}{4l}x_3\right) \ldots + G_a\sin\left(\frac{n\pi}{4l}x_a\right),$$

where n is an odd number 3, 5, 7 . . . , a is the number of acoustic drivers, l is the effective length of the waveguide, $x_l \ldots x_a$ indicate the proportional distance from the open end the waveguide, and G is the gain applied to the corresponding acoustic driver. The acoustic waveguide maybe an open-open waveguide and wherein the acoustic drivers may be placed and the gains selected according to the formula $$MF_{\frac{n\lambda}{2}} = G_1\sin\left(\frac{n\pi}{2l}x_1\right) + G_2\sin\left(\frac{n\pi}{2l}x_2\right) + G_3\sin\left(\frac{n\pi}{2l}x_3\right) \ldots + G_a\left(\frac{n\pi}{2l}x_a\right)$$

where n is an integer greater than one, a is the number of acoustic drivers, l is the effective length of the waveguide, measured from an end, $x_l \ldots x_a$ indicate the proportional distance from an end of the waveguide and G is the gain applied to the corresponding acoustic driver. The waveguide may be a conical waveguide and the acoustic drivers may be positioned according to the formula $$MF_n = \frac{\sin\left(\frac{2\pi}{c}f_n(x_1+d)\right)}{\frac{2\pi}{c}f_n(x_1+d)} + \frac{\tan\frac{\left(\frac{2\pi}{c}f_nL\right)\cos\left(\frac{2\pi}{c}f_n(x_1+d)\right)}{\sqrt{\frac{A_C}{A_O}-1}\ \frac{2\pi}{c}f_n(x_1+d)}} + \frac{\sin\left(\frac{2\pi}{c}f_n(x_2+d)\right)}{\frac{2\pi}{c}f_n(x_2+d)} + \frac{\tan\frac{\left(\frac{2\pi}{c}f_nL\right)\cos\left(\frac{2\pi}{c}f_n(x_2+d)\right)}{\sqrt{\frac{A_C}{A_O}-1}\ \frac{2\pi}{c}f_n(x_2+d)}} + \ldots \frac{\sin\left(\frac{2\pi}{c}f_n(x_a+d)\right)}{\frac{2\pi}{c}f_n(x_a+d)} + \frac{\tan\frac{\left(\frac{2\pi}{c}f_nL\right)\cos\left(\frac{2\pi}{c}f_n(x_a+d)\right)}{\sqrt{\frac{A_C}{A_O}-1}\ \frac{2\pi}{c}f_n(x_a+d)}} = 0$$

for each mode, where L represents the effective length of the waveguide, $f_n$ represents the frequency corresponding with the mode, $A_o$ represents the cross-sectional area at the open, end, $A_c$ represents the cross-sectional, area at the closed end, x represents the proportional position from the open end, and d is given by $$d = \frac{L}{\sqrt{\frac{A_C}{A_O}-1}},$$

and a is the number of acoustic drivers.

In another aspect, a method for operating an acoustic waveguide, includes radiating, by a plurality of acoustic drivers, at least two of the acoustic drivers placed more than a diameter apart, into an acoustic waveguide at positions at which the modal function corresponding with one mode is non-zero and so that the total excitation of the one mode is substantially zero. The radiating may include radiating by the plurality of acoustic drivers at positions in the waveguide at which the modal function corresponding with another mode is non-zero and so that the total excitation of the another mode is substantially zero. The waveguide maybe an open-closed waveguide and the radiating may include radiating into the waveguide at positions according the formula $$MF_{\frac{n\lambda}{4}} \sin\left(\frac{n\pi}{4l}x_1\right) + \sin\left(\frac{n\pi}{4l}x_2\right) + \sin\left(\frac{n\pi}{4l}x_3\right) \ldots + \sin\left(\frac{n\pi}{4l}x_a\right) = 0$$

where n is an odd integer greater than one indicating modes not to be excited, a is the number of acoustic drivers, l is the effective length of the waveguide, measured from the open end, and $x_l \ldots x_a$ indicate the proportional position along the waveguide. The waveguide is an open-open waveguide and wherein the radiating comprises radiating into the waveguide at positions according to the formula $$MF_{\frac{n\lambda}{2}} \sin\left(\frac{n\pi}{2l}x_1\right) + \sin\left(\frac{n\pi}{2l}x_2\right) + \sin\left(\frac{n\pi}{2l}x_3\right) \ldots + \sin\left(\frac{n\pi}{2l}x_a\right) = 0$$

where n is an integer greater than one, a is the number of acoustic drivers, l is the effective length of the waveguide, measured from an end, and $x_l \ldots x_a$ indicate the proportional position along the waveguide. The method may further include providing each acoustic driver with an audio signal and applying a different gain to the audio signal to at least two of the acoustic drivers. The waveguide may be a conical waveguide and the radiating may include radiating into the waveguide at positions according to the formula $$MF_n = \frac{\sin\left(\frac{2\pi}{c} f_n(x_1 + d)\right)}{\frac{2\pi}{c} f_n(x_1 + d)} + \tan\frac{\left(\frac{2\pi}{c} f_n L\right)\cos\left(\frac{2\pi}{c} f_n(x_1 + d)\right)}{\sqrt{\frac{A_C}{A_O} - 1}\ \frac{2\pi}{c} f_n(x_1 + d)} + \frac{\sin\left(\frac{2\pi}{c} f_n(x_2 + d)\right)}{\frac{2\pi}{c} f_n(x_2 + d)} + \tan\frac{\left(\frac{2\pi}{c} f_n L\right)\cos\left(\frac{2\pi}{c} f_n(x_2 + d)\right)}{\sqrt{\frac{A_C}{A_O} - 1}\ \frac{2\pi}{c} f_n(x_2 + d)} + \ldots \frac{\sin\left(\frac{2\pi}{c} f_n(x_a + d)\right)}{\frac{2\pi}{c} f_n(x_a + d)} + \tan\frac{\left(\frac{2\pi}{c} f_n L\right)\cos\left(\frac{2\pi}{c} f_n(x_a + d)\right)}{\sqrt{\frac{A_C}{A_O} - 1}\ \frac{2\pi}{c} f_n(x_a + d)} = 0$$

for each mode, where L represents the effective length of the waveguide, $f_n$ represents the frequency corresponding with the mode, $A_o$ represents the cross-sectional area at the open end, $A_c$ represents the cross-sectional area at the closed end, x represents the proportional position from the closed end, and d is given by $$d = \frac{L}{\sqrt{\frac{A_C}{A_O} - 1}},$$

and a is the number of acoustic drivers.

In another aspect, an acoustic device includes a first acoustic waveguide having two open ends; a second acoustic waveguide; and an acoustic driver having a first and second radiating surface positioned so that the first radiating surface radiates into the first waveguide and the second surface radiates into the second waveguide. Two open ends of the first waveguide may share a common exit. The first waveguide may encircle the second waveguide. The acoustic device may further include a second acoustic driver having a first and a second radiating surface positioned so that the first radiating surface radiates acoustic energy into the first waveguide. The second acoustic driver may be positioned so that the second radiating surface of the second acoustic driver radiates into the second waveguide. The second acoustic driver may be positioned so that the second radiating surface of the second acoustic driver radiates into a third waveguide.

In another aspect, an acoustic device includes an acoustic driver and an acoustic waveguide with two open ends. The two open ends may share a common exit. The acoustic device may further include an acoustic driver having two radiating surfaces positioned so that one radiating surface radiates into the waveguide and so that the second radiating surface radiates into a second acoustic waveguide. The acoustic waveguide may encircle a second acoustic waveguide. The acoustic waveguide may encircle a third acoustic waveguide. The second acoustic waveguide and the third acoustic waveguide may share a common opening.

In another aspect, an acoustic structure includes an extruded member forming a first closed channel, and an open channel; a first endplate; a second endplate; and a backplate, wherein the first endplate and the second endplate may be attachable to the extruded member to form a waveguide. The extruded member may form a second closed channel and the structure further may include a third endplate and a fourth endplate. The third endplate and the fourth endplate may be attachable to the extruded member to form a second waveguide.

In another aspect a method for forming an acoustic waveguide may include extruding a member forming a first closed channel and an open channel; mounting an acoustic driver to the extruded member; and attaching a first pair of endplates and a backplate to form the acoustic waveguide. The extruding may further include extruding the member to form a second closed channel and attaching a second pair of endplates to form a second waveguide.

Other features, objects, and advantages will become apparent from the following detailed description, when read in connection with the following drawing, in which;

DETAILED DESCRIPTION

Figure 1A:
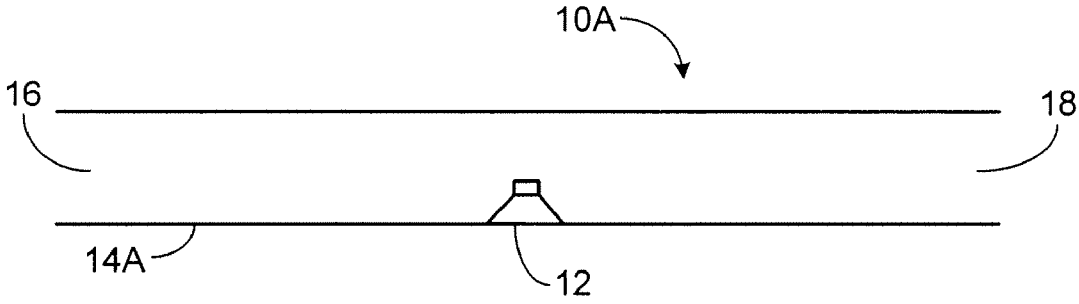
FIGS. 1A and 1B are diagrammatic views of waveguide structures.

FIG. 1A shows an acoustic waveguide system 10A. An acoustic driver (transducer) 12 is mounted in an acoustic waveguide 14A having two open ends 16 and 18 (hereinafter, a waveguide having two open ends will be referred to as an "open-open waveguide"). The acoustic driver can be placed at other positions along the waveguide. The acoustic driver radiates directly to the environment and also radiates acoustic energy into the waveguide. The acoustic energy radiated into the waveguide 14A is radiated to the environment through the open ends 16 and 18. The total acoustic energy radiated to the environment by the acoustic waveguide system is the sum of the acoustic energy radiated directly to the environment by the acoustic driver and the acoustic energy radiated to the environment by the open ends of the waveguide.

Figure 1B:
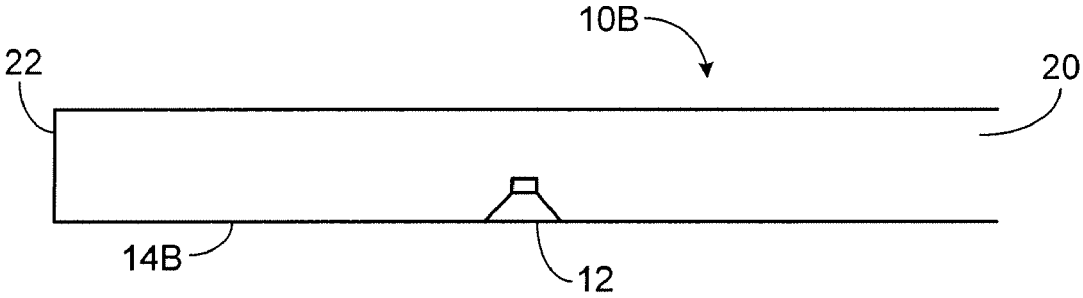

FIG. 1B shows an acoustic waveguide system 10B. An acoustic driver 12 is mounted in an acoustic waveguide 14B having one open end 20 and a closed end 22 (hereinafter, a waveguide having one open end and one closed end will be referred to as an "open-closed waveguide"). The acoustic driver may be placed at other positions along the waveguide, or it may replace part or all of the closed end 22 of the waveguide. The acoustic driver radiates energy directly into the environment and also radiates acoustic energy into the waveguide. The acoustic energy radiated into the waveguide 148 is radiated to the environment through the open end 20. The total acoustic energy radiated to the environment by the acoustic waveguide system is the sum of the acoustic energy radiated directly to the environment by the acoustic driver and the acoustic energy radiated to the environment by the open end of the waveguide.

The effective acoustic length of a waveguide may be different than the physical length of the waveguide. The length of the waveguide may be the physical length or may be the equivalent effective acoustic length, including end effect corrections.

Acoustic waveguides are characterized by "modes". Modes are described by "modal functions", as will be discussed below. Modes of open-closed waveguides occur at $$f_n = \frac{(2n-1)c}{4L}$$

(hereinafter modal frequencies), where n a positive integer, c is the speed of sound in air (which for the purposes of this specification is a constant) and L is the effective length of the waveguide, including end effects. Modes of open-open waveguides occur at $$f_n = \frac{nc}{2L}$$

(hereinafter modal frequencies), where c is the speed of sound in air (which for the purposes of this specification is a constant), where n is a positive integer, and L is the effective length of the waveguide, including end effects. Modes are characterized by standing waves, with a pressure maximum, or antinode, at the closed end of the waveguide, and a pressure minimum, or node, at or near the open end of the waveguide. Typically when an acoustic driver is acoustically coupled to a waveguide, radiation from the acoustic driver excites modes of the waveguide. Acoustic coupling of one or more acoustic drivers at specific locations along the waveguide affects the amount of excitation of each mode as will be described below.

Figure 1C:
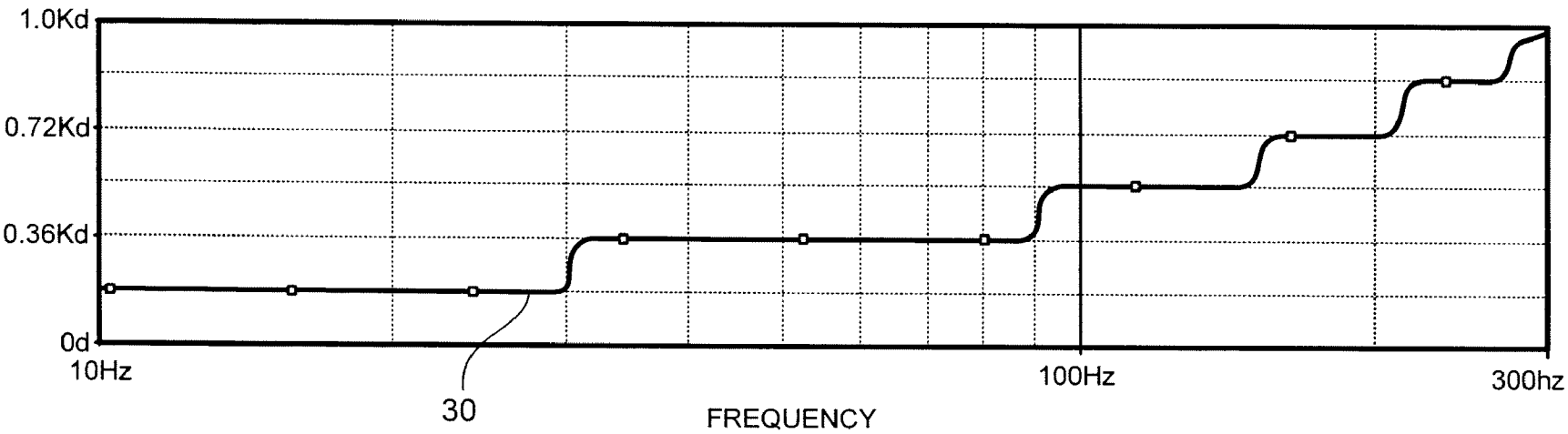
FIGS. 1C-1E are computer simulations of acoustic aspects of the waveguides of FIG. 1A or 1B or both.
Figure 1D:
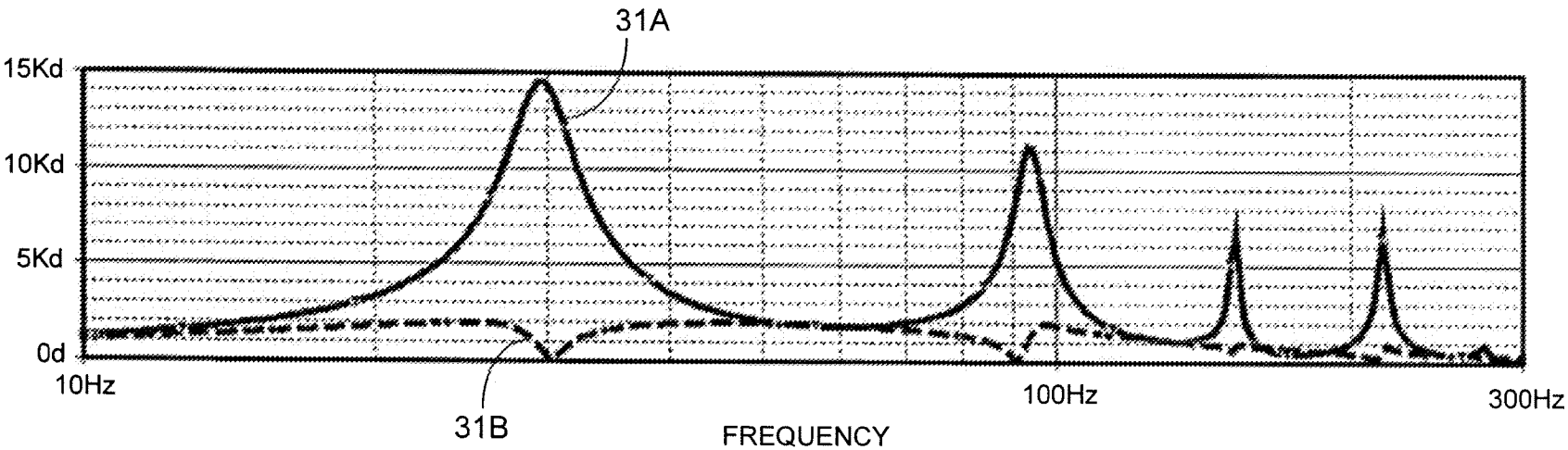
Figure 1E:
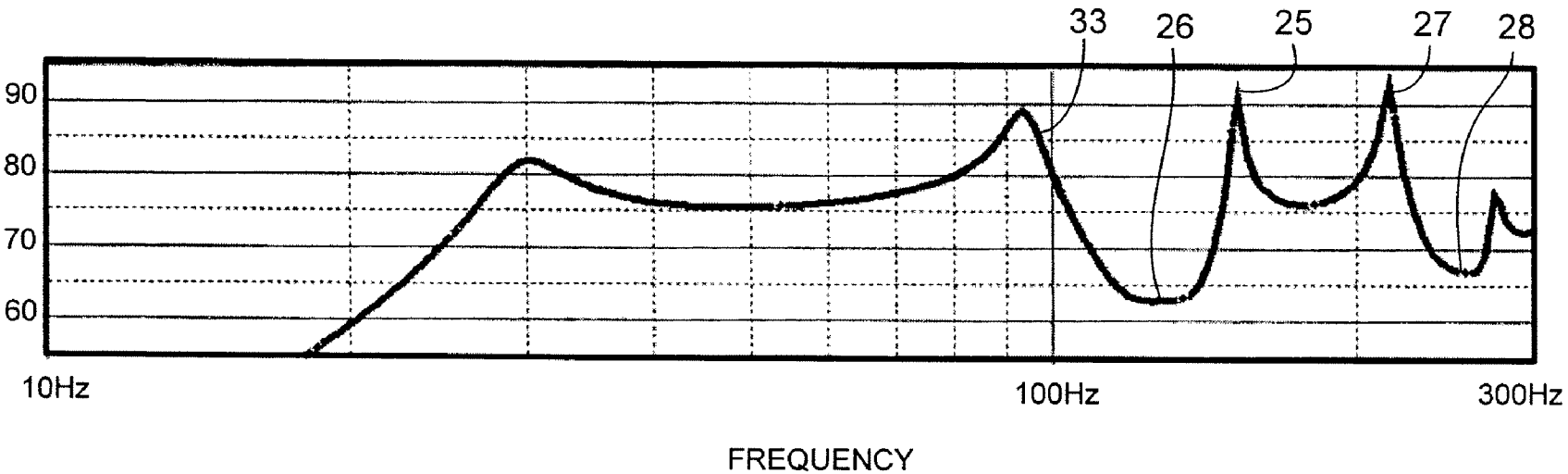

FIG. 1C shows a curve 30 of phase difference between the radiation from the waveguide end 20 and the radiation from the acoustic driver 12. FIG. 1D shows a curve 31A of the dB SPL (sound pressure level) of the output of the open end 20 of the waveguide, and a curve 31B of the dB SPL of the direct radiation from the acoustic driver. FIG. 1E shows a curve 33 of the amplitude of the combined output of the open end 20 of the acoustic waveguide and of the acoustic driver 12. Output peaks, for example 25 and 27, occur at modal frequencies and output dips, for example 26 and 28, occur at frequencies at which the outputs of the open end of the waveguide and the acoustic driver are out-of-phase (180 degrees, 540 degrees) and of approximately equal amplitude.

The peaks and dips are undesirable acoustically, and it is desirable to smooth the frequency response, by eliminating the peaks and dips to provide a flat frequency response curve. One way of eliminating transitions from in-phase to out-of-phase and from out-of-phase to in-phase operation is to avoid exciting modes that occur in open-closed waveguides at frequencies $$f_n = \frac{(2n-1)c}{4L}$$

(where n is an integer >1, . . . , c is the speed of sound, and L is the length of the waveguide). It is especially desirable to minimize the modes where n is two or three, because these wavelengths have corresponding frequencies that are within the useful range of operation of most waveguide systems.

Figure 2A:
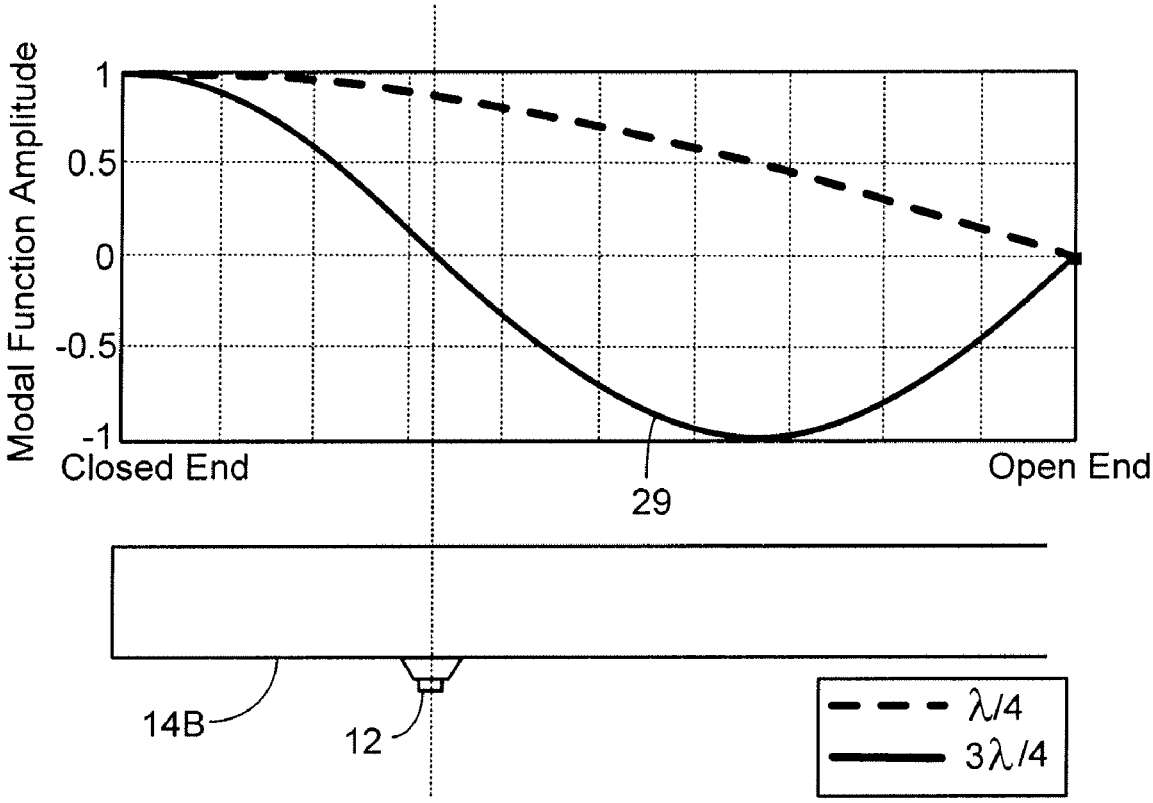
FIGS. 2A-2C, 3, 4, and 5A are diagrammatic views of waveguide systems and associated diagrams showing the relationship of the placement of one or more acoustic drivers relative to one or more modal functions of the corresponding waveguide systems.

One method of avoiding exciting modes at frequencies of $$f_n = \frac{(2n-1)c}{4L}$$

is to place the acoustic driver at a position in the waveguide at which the value of the modal function (which describes the spatial distribution of acoustic pressure at a particular modal frequency of $$f_n = \frac{(2n-1)c}{4L})$$

is near zero. In FIG. 2A, the acoustic driver 12 is at a position in an open-closed waveguide 14B at which the value of a modal function represented by curve 29 at the n=2 modal frequency which is $$\frac{3c}{4L}$$

is near zero.

Figure 2B:
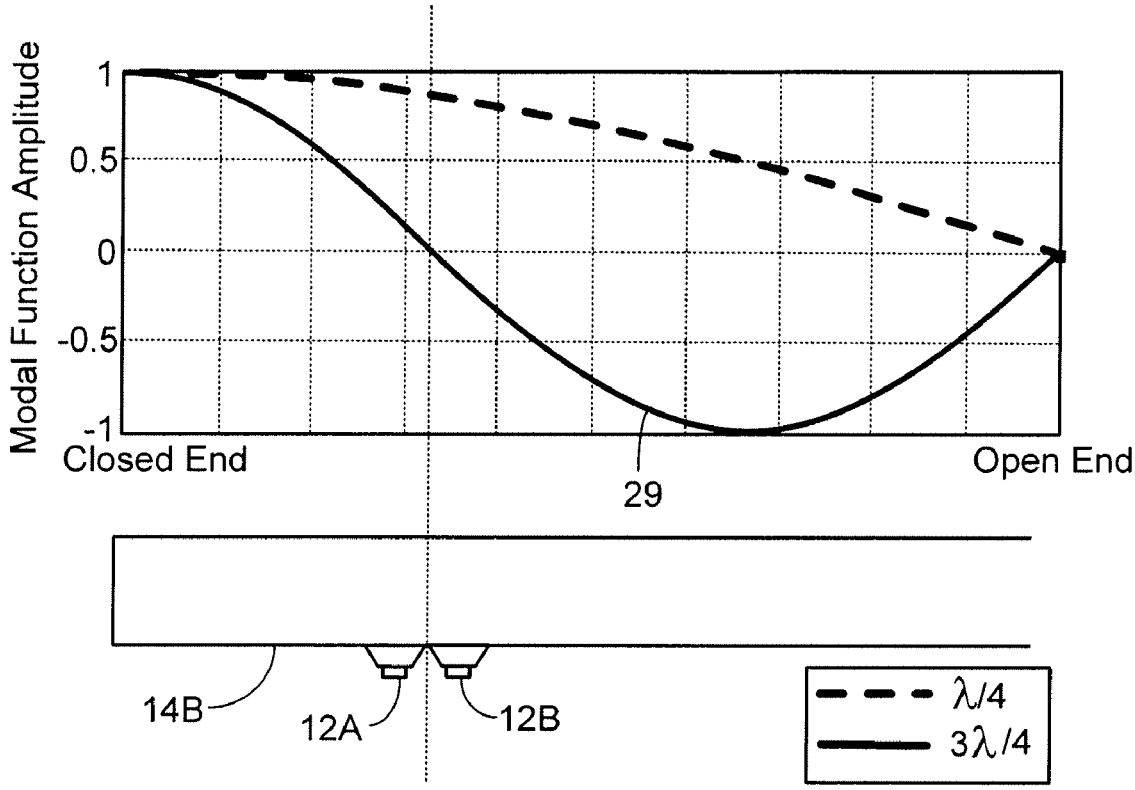
Figure 2C:
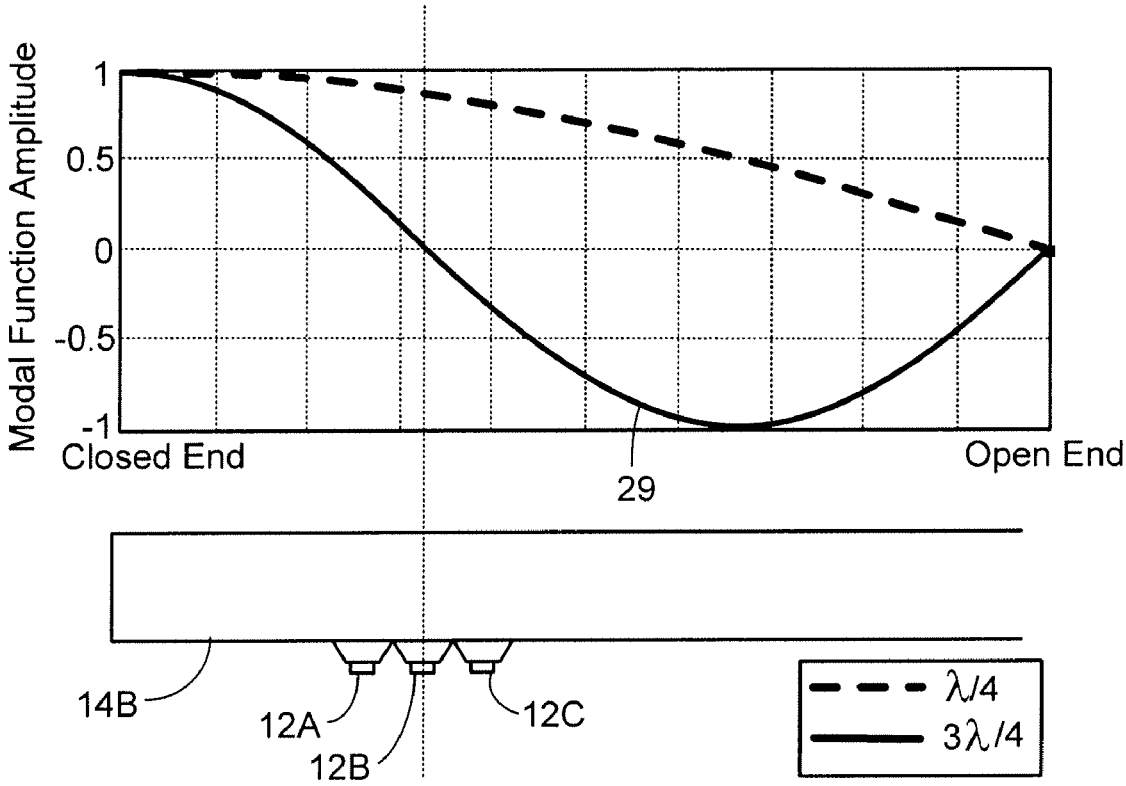

If one acoustic driver does not provide sufficient output, the single acoustic driver may be replaced by two or more acoustic drivers, placed as closely as practical with the acoustic center of the acoustic drivers at the position in the waveguide at which the value of the modal function is near zero. For example, FIGS. 2B and 2C show, respectively, two and three acoustic drivers (12A, 12B and 12A, 12B, 12C, respectively) placed as closely as practical, with the acoustic center of the acoustic drivers at a position at which the value of the modal function is near zero.

If more than one acoustic driver is required to provide sufficient acoustic output, it may be inconvenient to place the acoustic drivers close to each other. Another way of controlling the excitation of modes in which the acoustic drivers do not need to be placed close to each other is to locate two acoustic drivers spaced apart, for example, so that the distance between the perimeters of the two acoustic drivers is more than a diameter of the acoustic drivers, at positions along a waveguide so that the magnitudes (absolute values) of the modal function corresponding to a particular mode or particular modes at the locations of the two acoustic drivers are equal, but of opposite sign. The total excitation of the mode or modes is the sum of the modal functions at the locations of the acoustic drivers, which in this case is zero due to the equal magnitude, opposite sign values of the modal functions.

Figure 3:
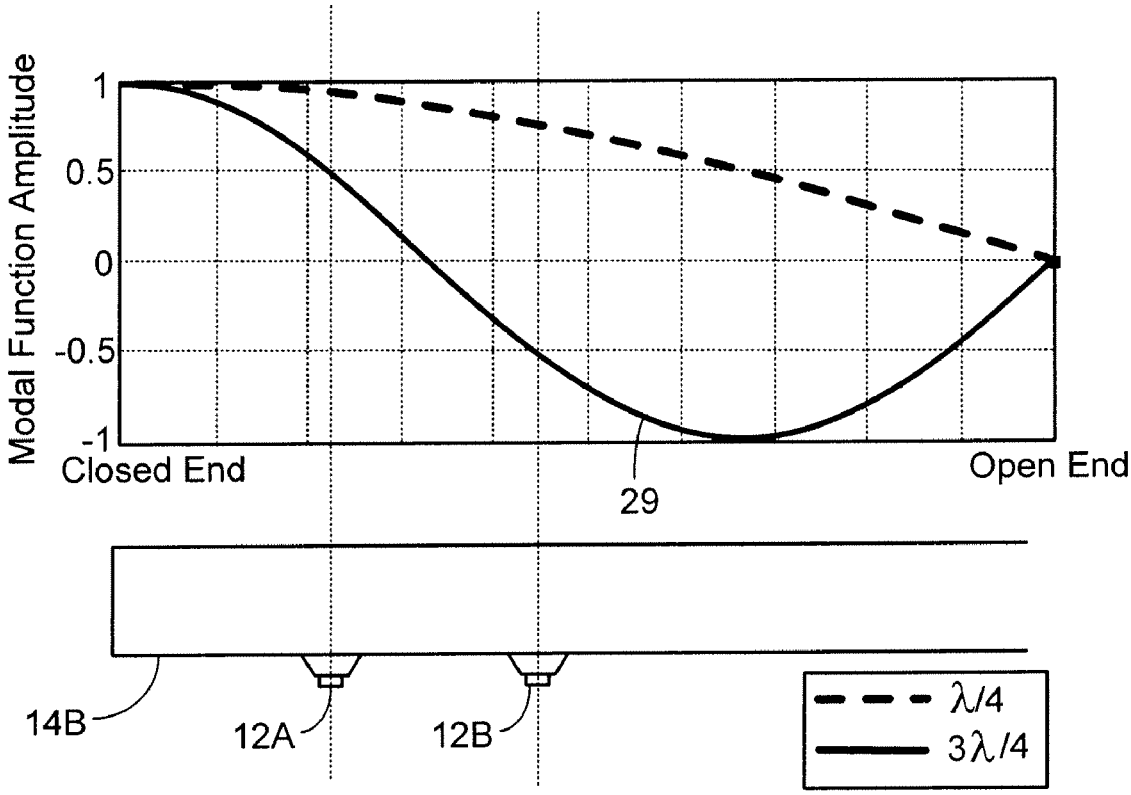

For example, in FIG. 3, acoustic drivers 12A and 12B are at positions in an open-closed waveguide at which the values of the modal function at the frequency of $$\frac{3c}{4L}$$

Figure 4:
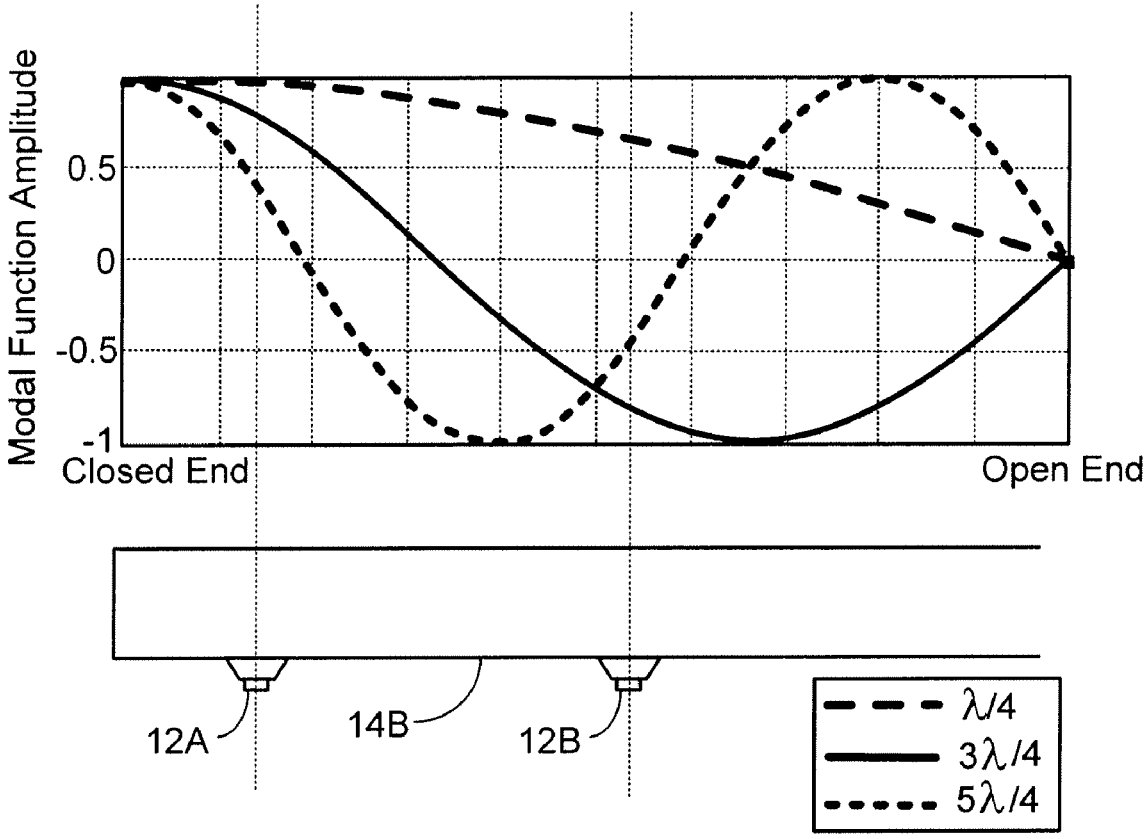

(that is, the mode at n=2), have approximately the same magnitude, but opposite sign. If the acoustic drivers are spaced apart, for example by more than the diameter of the acoustic drivers, the acoustic drivers can be placed so that the values of the modal functions corresponding to more than one of the $$f_n = \frac{(2n-1)c}{4L}$$

frequencies are of substantially equal magnitude but opposite sign. For example, in the arrangement of FIG. 4, acoustic drivers 12A and 12B are at positions so that radiation from the acoustic drivers enters the waveguide at positions at which the values of the modal function corresponding to the frequency $$\frac{3c}{4L}$$

is of approximately equal magnitude, but opposite sign and at which the values of the modal function corresponding to the frequency $$\frac{5c}{4L}$$

are of approximately equal magnitude, but opposite sign. With this spatial arrangement of acoustic drivers, the n=2 and n=3 modes are therefore not excited, thereby avoiding the peaks at the corresponding modal frequencies and avoiding phase changes at or near these modal frequencies.

Other methods of driving the modal function to zero do not require pairs of acoustic drivers to have equal magnitude and opposite sign, but rather have other combinations of magnitude and sign that sum to zero.

The modal functions in an open-closed waveguide are expressed as:

$$MF_{\frac{n\lambda}{4}} = \sin\left(\frac{n\pi}{4l}x_1\right) + \sin\left(\frac{n\pi}{4l}x_2\right) + \sin\left(\frac{n\pi}{4l}x_3\right) \ldots + \sin\left(\frac{n\pi}{4l}x_a\right),$$

where n is an odd number 3, 5, 7 . . . , a is the number of acoustic drivers, and l is the effective length of the waveguide, measured from the open end. The values $x_l \ldots x_a$ indicate the proportional position along the waveguide from the open end of the waveguide; for example $x_l$=0.32 l indicates that an acoustic driver should be placed at 0.32 l from the open end of the waveguide. Values for a can then be selected (for example, based on acoustic output requirements or the number of modes not to be excited) and values for $x_l \ldots x_a$ may then be calculated mathematically, or selected, for example by computer simulation, to minimize the value of the modal function, and preferably drive the value of the modal function to zero. It may be difficult or even mathematically impossible to drive the value of the modal function to zero; however a beneficial effect can be obtained by deriving x values that drive the expressions close to zero. For open-open waveguides, the modal functions are expressed as:

$$MF_{\frac{n\lambda}{2}} = \sin\left(\frac{n\pi}{2l}x_1\right) + \sin\left(\frac{n\pi}{2l}x_2\right) + \sin\left(\frac{n\pi}{2l}x_3\right) \ldots + \sin\left(\frac{n\pi}{2l}x_a\right),$$

where n is an integer greater than one, a is the number of acoustic drivers, and l is the effective length of the waveguide.

The values $x_l \ldots, x_a$ indicate the proportional position along the waveguide from an end; for example $x_l$=0.32 l indicates that an acoustic driver should be placed at 0.32 l from an end of the waveguide. Values for a can then be selected and values for $x_l \ldots x_a$ may then be calculated mathematically, or selected, for example by computer simulation, to minimize the value of the modal function, and preferably drive the value of the modal function to zero. It may be difficult or even mathematically impossible to drive the value of the modal function to zero; however a beneficial effect, can be obtained by deriving x values that drive the expressions close to zero.

Figure 5A:
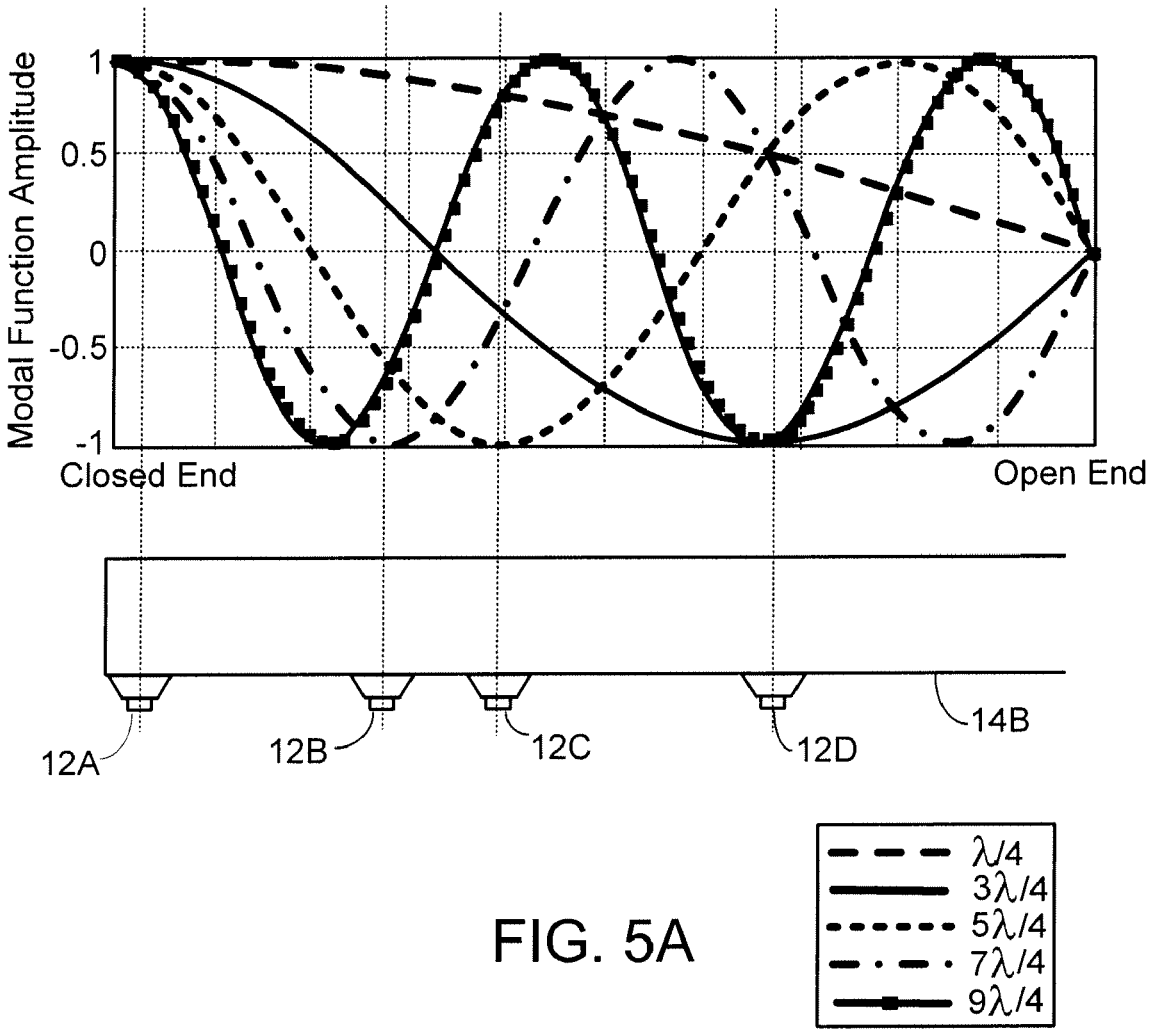

One method of driving the modal function to zero is shown in FIG. 5A. In the example of FIG. 5A, four acoustic drivers 12A, 12B, 12C, and 12D are positioned so that the value of the modal function, corresponding to the frequency $$\frac{3c}{4L}$$

is approximately zero, so that the value of the modal function corresponding to the frequency $$\frac{5c}{4L}$$

is approximately zero, so that the value of the modal function corresponding to the frequency $$\frac{7c}{4L}$$

is approximately zero, and so the value of the modal function corresponding to the frequency $$\frac{9c}{4L}$$

is approximately zero.

The equations presented herein assume that the acoustic drivers are point sources of acoustic radiation. In practical implementations, acoustic drivers have radiating surfaces that have finite dimensions and do not act as point sources at all frequencies. However, beneficial reduction in the excitation of modes and therefore reducing the effect of the output peaks and dips can be obtained if some portion of the radiating surface of the acoustic driver is positioned at the described position of the waveguide. For example. If the acoustic driver has a circular radiating surface with a diameter of 10 cm (radius of 5 cm), and the indicated position of an acoustic driver is 0.32 l, with l=1.7 m=170 cm so that 0.32 l=54.4 cm from an end of the waveguide, if the center of the radiating surface is between 53.9 cm and 54.9 cm from the end of the waveguide, so that some portion of the radiating surface of the acoustic driver is positioned at 54.4 cm from the end of the waveguide, there is a beneficial effect with regard to reducing the effect of output peaks and dips.

Figure 5B:
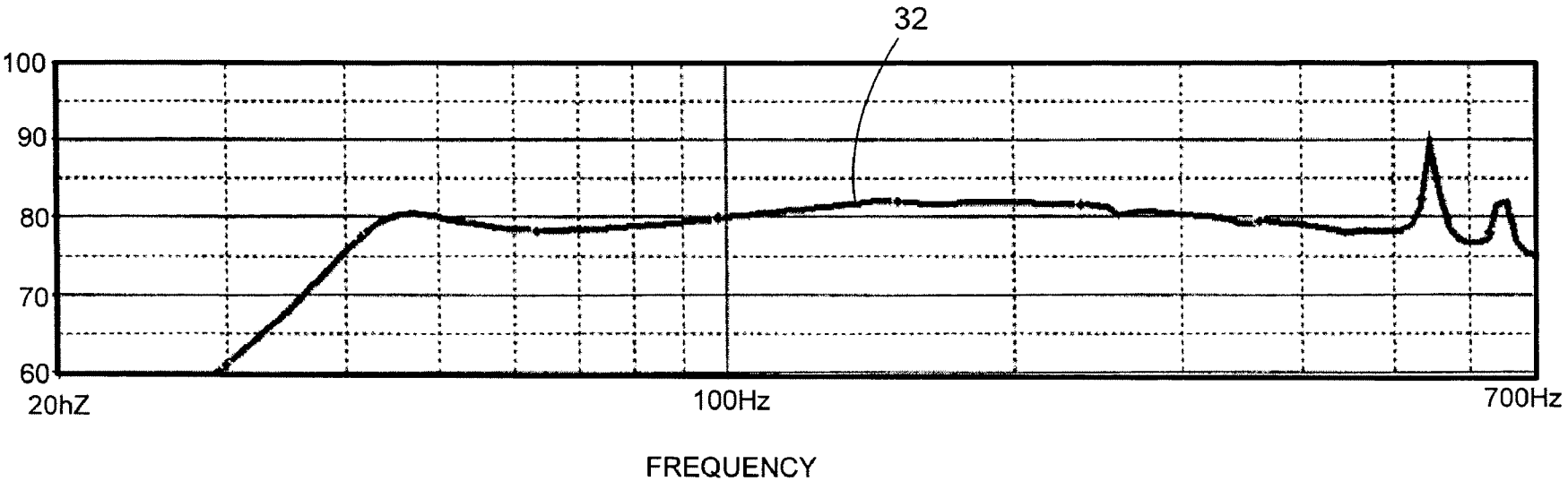
FIGS. 5B and 5C are computer simulations of acoustic aspects of the waveguides of FIG. 5A.

FIG. 5B is a plot 32 of dB SPL at one meter of the arrangement of FIG. 5A. There are no pronounced dips or peaks over a range of about 40 Hz to about 550 Hz, a range of almost four octaves. This wide range can be taken advantage of in at least two ways. One way is extending the range of a bass module into frequencies typically radiated by mid-range or tweeter speakers. Another way is to extend the range of a bass module downward to provide bass to lower frequencies than can be provided by other bass modules.

Figure 5C:
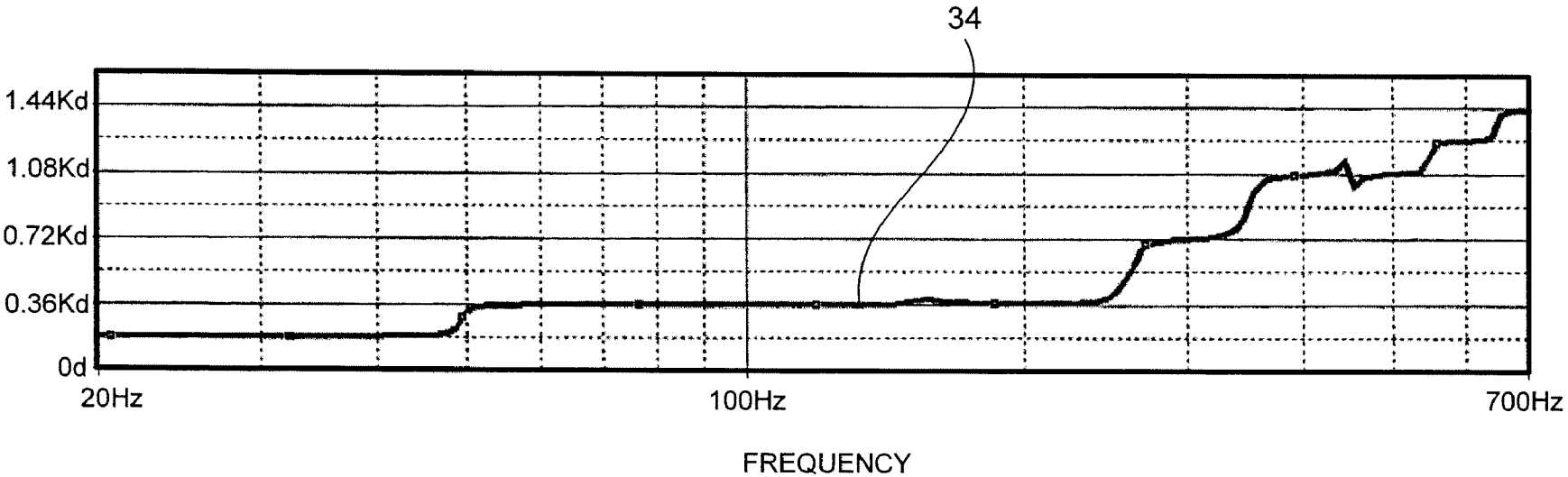

FIG. 5C shows that the phase difference 34 between the radiation of the acoustic driver and the waveguide exit is zero (or the equivalent of zero, for example 360, 720, etc. degrees), except for some minor deviations, over a very wide range of frequencies.

Increased flexibility in the placement of two acoustic drivers in an open-closed waveguide is possible by placing the acoustic drivers at positions at which the magnitudes of the previously shown modal functions are not equal in the previously discussed systems, the electronic gains applied to the two acoustic transducers were assumed to be equal. By assigning gains $G_1$ and $G_2$ at the modal frequencies to the signals provided to acoustic drivers 12A and 12B, the modal functions take on the following form:

$$MF_{\frac{n\lambda}{4}} = G_1 \sin\left(\frac{n\pi}{4l}x_1\right) + G_2 \sin\left(\frac{n\pi}{4l}x_2\right)$$

and $$MF_{\frac{n\lambda}{2}} = G_1 \sin\left(\frac{n\pi}{2l}x_1\right) + G_2 \sin\left(\frac{n\pi}{2l}x_2\right).$$

Figure 6:
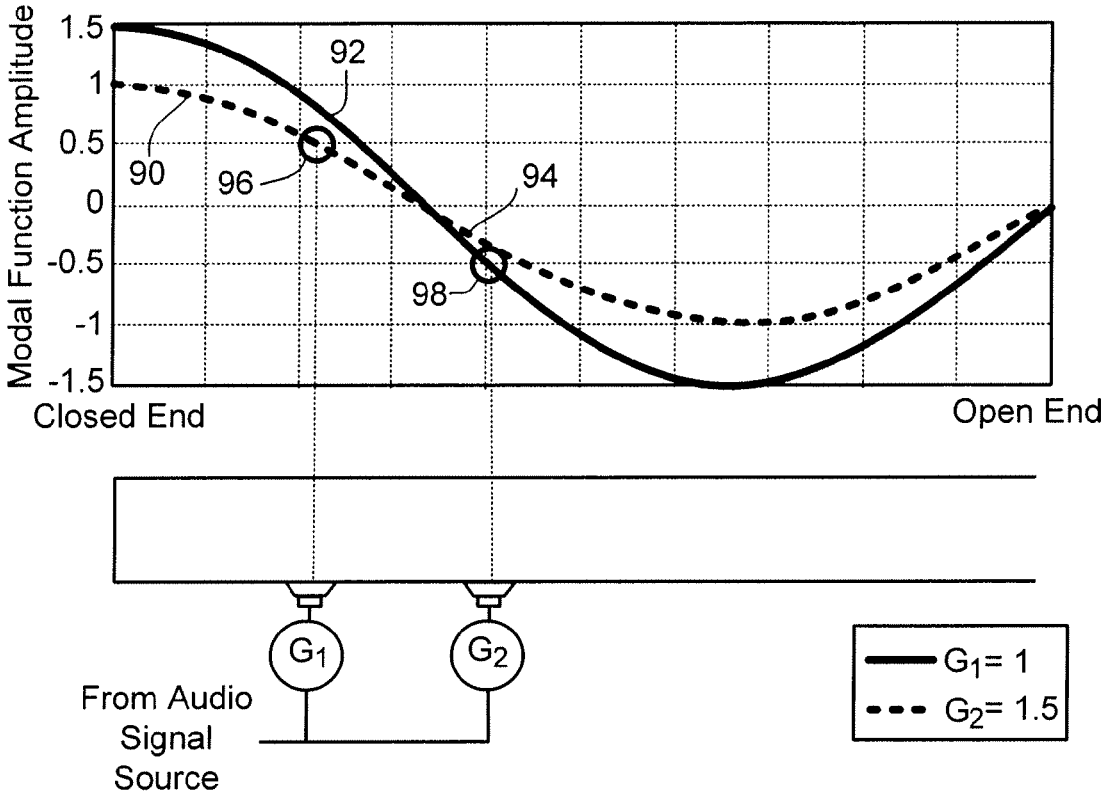
FIG. 6 is a diagrammatic view of a waveguide system and an associated diagram showing the relationship of the placement of acoustic drivers relative to modal functions of the corresponding waveguide system.

FIG. 6 shows a configuration similar to the configuration of FIG. 3, but wife the acoustic drivers at positions which make the with-gain modal function equal to zero. FIG. 6 also shows the two terms of the with-gain n=2 modal function, with $G_1$=1 (curve 90), and $G_2$=1.5 (curve 92). The magnitude 94 of the modal function (which is equal to curve 90) at the position of the acoustic driver to which gain $G_2$ is applied is less than the magnitude 96 of the modal function at the position of the acoustic driver to which gain $G_1$ is applied. However, because gain $G_2$ is greater than gain $G_1$ the magnitude 98 of the with-gain modal function at the position of the acoustic driver to which gain $G_2$ is applied is equal to the magnitude 96 of the with-gain modal function at the position of the acoustic driver to which gain $G_1$ is applied. Since the signs are opposite, the net excitation of the n=2 mode is approximately zero. If need be, the pin $G_a$ of each driver can be different at each modal frequency. This approach can be expanded to any number of acoustic drivers with different gains by using the following general modal function equation for each mode, n, of open-closed waveguides:

$$MF_{\frac{n\lambda}{4}} = G_1 \sin\left(\frac{n\pi}{4l}x_1\right) + G_2 \sin\left(\frac{n\pi}{4l}x_2\right) + G_3 \sin\left(\frac{n\pi}{4l}x_3\right) \ldots + G_a \sin\left(\frac{n\pi}{4l}x_a\right).$$

Similarly, the modal functions for open-open waveguides whose acoustic drivers have different gains take the following form;

$$MF_{\frac{n\lambda}{2}} = G_1 \sin\left(\frac{n\pi}{2l}x_1\right) + G_2 \sin\left(\frac{n\pi}{2l}x_2\right) + G_3 \sin\left(\frac{n\pi}{2l}x_3\right) \ldots + G_a \sin\left(\frac{n\pi}{2l}x_a\right).$$

In a further refinement, the sensitivities of the acoustic drivers can be taken into account.

Determining placement of acoustic drivers is not limited to acoustic waveguides or systems that have a known modal function describing the pressure distribution at known modal frequencies. The modal frequencies and the modal functions can be found using modeling techniques (such as lumped element modeling, finite element modeling, and others) or can be found empirically. Once the modal functions (typically expressed as a pressure distribution lookup table) have been found, by modeling or other techniques, the techniques described above can be used to locate the acoustic drivers.

The principle of avoiding exciting modes can be extended to conical tapered waveguides by first finding the modal frequencies, $f_n$, which are frequencies that satisfy the equation:

$$\frac{2\pi f_a L}{c\left[1-\sqrt{\frac{A_O}{A_C}}\right]} = \tan\left(\frac{2\pi f_a L}{c}\right),$$

where c is the speed of sound, $A_c$ is the waveguide area at the (larger) closed end, $A_o$ is the waveguide are at the (smaller) open end, and L is the effective waveguide length. For conical waveguides, the modal function at the nth modal frequency for each acoustic driver is expressed as:

$$MF_n = \frac{\sin\left(\frac{2\pi}{c} f_n(x+d)\right)}{\frac{2\pi}{c} f_n(x+d)} + \tan\frac{\left(\frac{2\pi}{c} f_n L\right)\cos\left(\frac{2\pi}{c} f_n(x+d)\right)}{\sqrt{\frac{A_C}{A_O}} - 1 \ \frac{2\pi}{c} f_n(x+d)}$$

where x represent the proportional position between 0 and L and d is given by $$d = \frac{L}{\sqrt{\frac{A_C}{A_O}} - 1},$$

For two acoustic drivers, one at $x_1$ and one at $x_2$ the expression is as follows:

$$MF_n = \frac{\sin\left(\frac{2\pi}{c} f_n(x_1+d)\right)}{\frac{2\pi}{c} f_n(x_1+d)} + \tan\frac{\left(\frac{2\pi}{c} f_n L\right)\cos\left(\frac{2\pi}{c} f_n(x_1+d)\right)}{\sqrt{\frac{A_C}{A_O}} - 1 \ \frac{2\pi}{c} f_n(x_1+d)} + \frac{\sin\left(\frac{2\pi}{c} f_n(x_2+d)\right)}{\frac{2\pi}{c} f_n(x_2+d)} + \tan\frac{\left(\frac{2\pi}{c} f_n L\right)\cos\left(\frac{2\pi}{c} f_n(x_2+d)\right)}{\sqrt{\frac{A_C}{A_O}} - 1 \ \frac{2\pi}{c} f_n(x_2+d)},$$

where $x_1$ and $x_2$ represent the proportional position from the open end, and where d is given by $$d = \frac{L}{\sqrt{\frac{A_C}{A_O}} - 1}.$$

For example, if for a 2:1 tapered waveguide $$\left(\frac{A_C}{A_O} = 2\right),$$

two acoustic drivers placed at 0.491 l and 0.911 l minimizes the excitation of the nth mode. The equation, maybe expressed more generally as:

$$MF_n = \frac{\sin\left(\frac{2\pi}{c} f_n(x_1+d)\right)}{\frac{2\pi}{c} f_n(x_1+d)} + \tan\frac{\left(\frac{2\pi}{c} f_n L\right)\cos\left(\frac{2\pi}{c} f_n(x_1+d)\right)}{\sqrt{\frac{A_C}{A_O}} - 1 \ \frac{2\pi}{c} f_n(x_1+d)} + \frac{\sin\left(\frac{2\pi}{c} f_n(x_2+d)\right)}{\frac{2\pi}{c} f_n(x_2+d)} + \tan\frac{\left(\frac{2\pi}{c} f_n L\right)\cos\left(\frac{2\pi}{c} f_n(x_2+d)\right)}{\sqrt{\frac{A_C}{A_O}} - 1 \ \frac{2\pi}{c} f_n(x_2+d)} + \cdots \frac{\sin\left(\frac{2\pi}{c} f_n(x_n+d)\right)}{\frac{2\pi}{c} f_n(x_n+d)} + \tan\frac{\left(\frac{2\pi}{c} f_n L\right)\cos\left(\frac{2\pi}{c} f_n(x_a+d)\right)}{\sqrt{\frac{A_C}{A_O}} - 1 \ \frac{2\pi}{c} f_n(x_a+d)}$$

for each mode, where a is the number of drivers. This method can be expanded in a similar fashion to those listed above, to cover up to four acoustic drivers and four modes, or more.

Figures 7A, 8A:
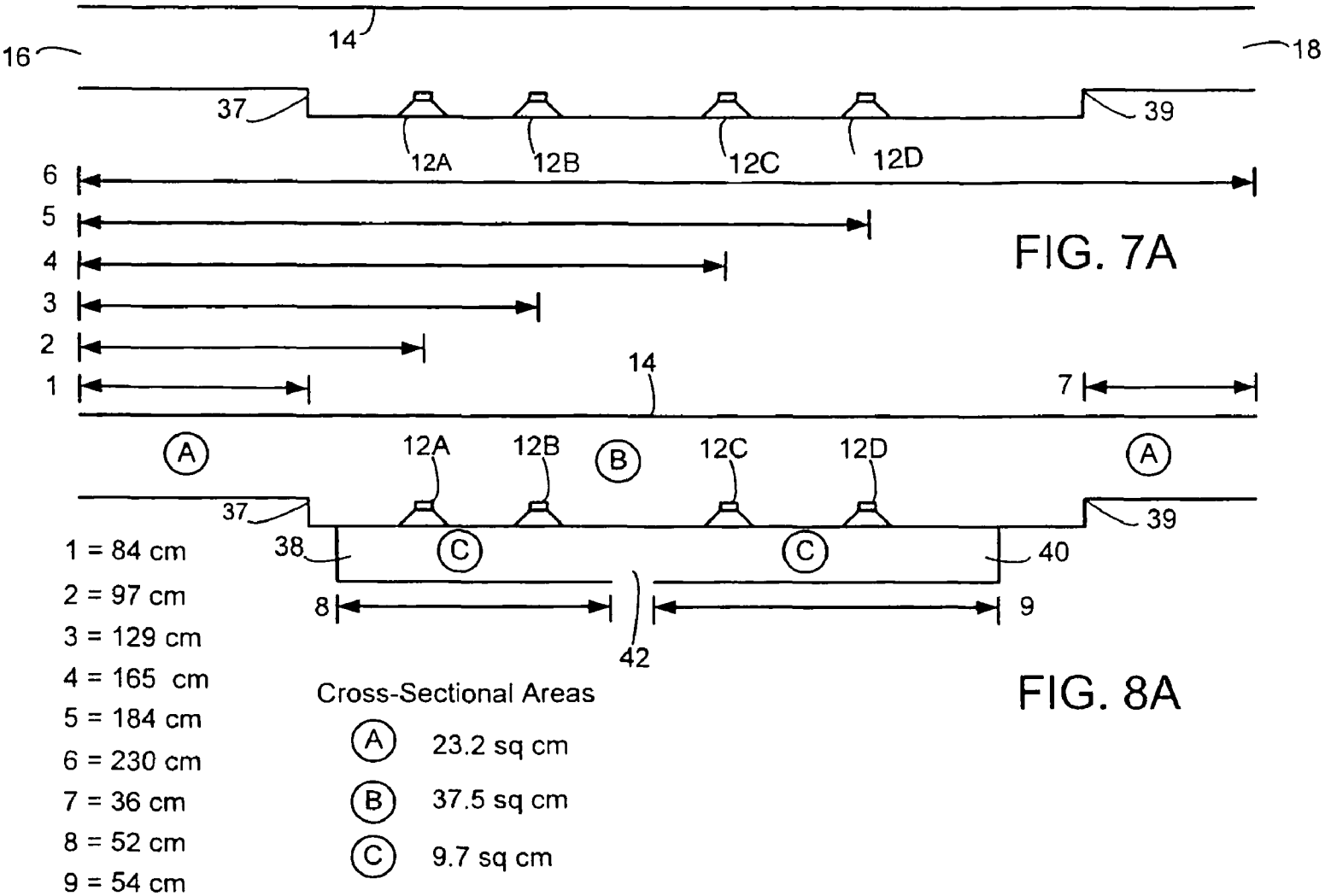
FIG. 7A is a diagrammatic view of a waveguide system embodying some acoustic driver placement principles and including some additional elements.
FIG. 8A is a diagrammatic view of the waveguide system of FIG. 7A including some additional elements.
Figure 7B:
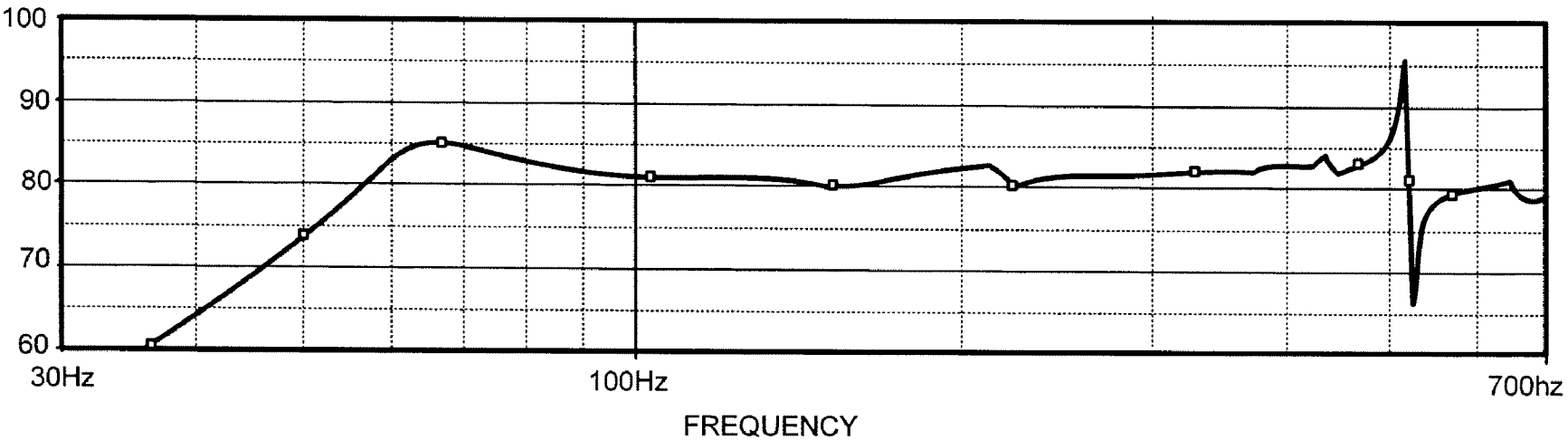
FIG. 7B is a computer simulation of acoustic aspects of the waveguide system of FIG. 7A.

FIG. 7A shows a waveguide system embodiment of the principles described above, with some added features. Acoustic drivers 12A, 12B, 12C, and 12D are mounted so that they radiate into an open-open waveguide 14, at positions noted in the figure. The waveguide 14 has two open ends 16 and 18. Waveguide 14 has two sections with an abrupt taper at points 37 and 39. The abrupt taper lowers the n=1 mode tuning frequency of the waveguide. A simulated plot 36 of dB SPL art one meter in FIG. 7B shows that the SPL radiated by the waveguide system is substantially flat (except for some minor deviations at frequencies at which the modal functions were excited by a small amount) from 60 Hz to about 480 Hz.

Figure 8B:
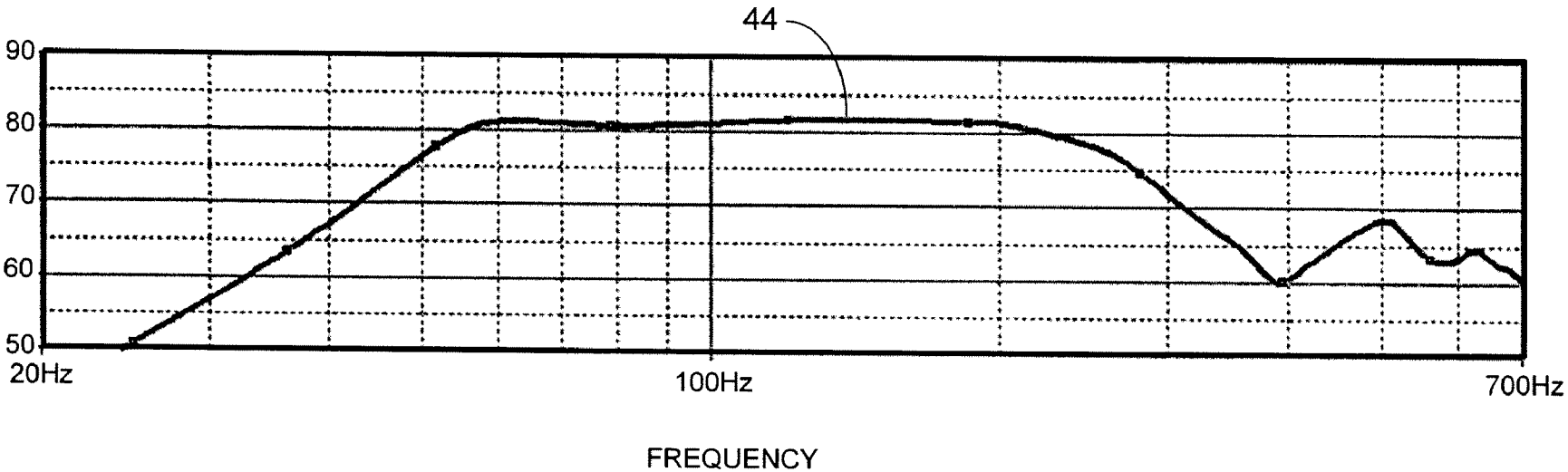
FIG. 8B is computer simulation of acoustic aspects of the waveguide system of FIG. 8A.

FIG. 8A shows the assembly of FIG. 7A with an additional feature and with the dimensions for one embodiment noted. Instead of radiating directly to the environment. Acoustic drivers 12A and 12B radiate into open-closed waveguide 38. Acoustic drivers 12C and 12D radiate into open-closed waveguide 40. The open-closed waveguides 38 and 40 share a common exit 42. FIG. 88 shows the dB SPL at one meter of the assembly of FIG. 8A. The plot 44 of FIG. 8B shows a roll-off at about 220 Hz, with some minor perturbations at frequencies at which the modal functions were excited by a small amount. This roll-off is advantageous in a practical loudspeaker because it simplifies the design of the crossover network and because it simplifies the design of the equalization circuitry. High frequency peaks 46 and 48, resulting from driver locations that lead to non-zero modal function values at high frequencies, can be significantly reduced by the method described in U.S. Pat. No. 6,278,789.

Figure 9:
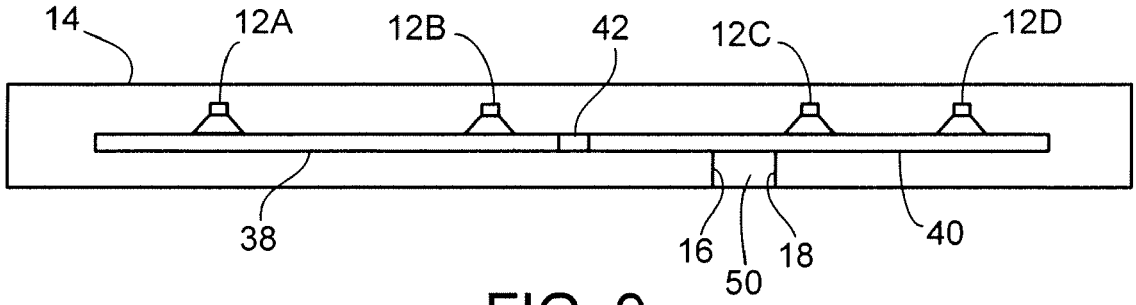
FIG. 9 is a diagrammatic view of an implementation of the waveguide system of FIG. 8A.

FIG. 9 shows the implementation of the embodiment of FIG. 8A. Waveguide 14 is folded so that it surrounds waveguides 38 and 40 and so that the two open ends 16 and 18 share a common exit 50. Common exit 42 (of waveguides 38 and 40) is oriented so that the opening is perpendicular to the page.

Figure 10:
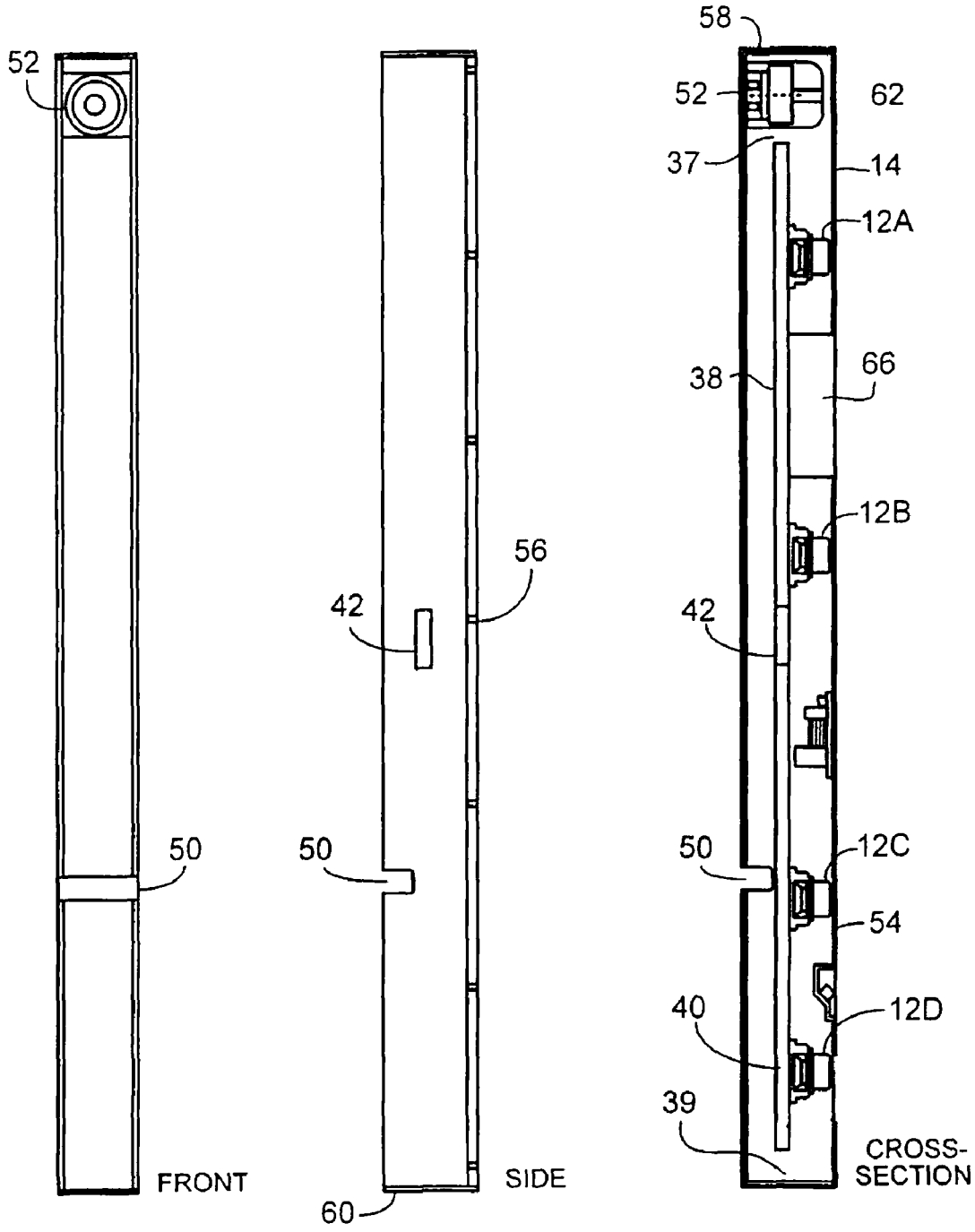
FIGS. 10 and 11 are views of a practical loudspeaker incorporating the waveguide system of FIG. 9.

FIG. 10 shows a practical loudspeaker according to the implementation of FIG. 9, with reference numerals representing the physical implementations of the corresponding elements of the previous figures. Acoustic driver 52 is a high frequency acoustic driver that provides the high frequency radiation for the waveguide system and which was not described earlier. Hie waveguide structure may be formed of an extruded portion 54, a back panel 56, and endplates, not shown in this view.

Figure 11:
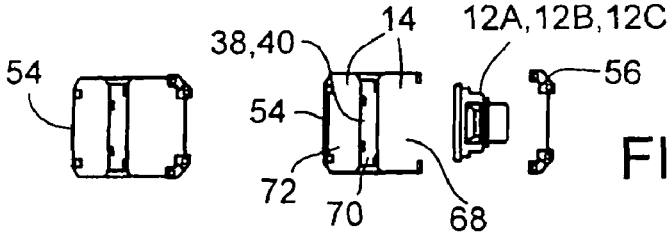

FIG. 11 shows a structure implementing structural elements of the loudspeaker of FIG. 10. The waveguides 14, 38 and 40 are formed of an extruded portion 54, for example of aluminum. The extruded portion 54 defines an open channel 68 and closed channels 70 and 72. Channel 70 does not run the entire length of the extruded portion 54 and channel 72 does run the entire length of extruded portion 54. Back panel 56 may be mechanically fastened to the extruded portion. Openings 42 and 50 may be formed in the extruded portion 54 by a mechanical router. End plates may be attached to the ends of closed channel 72 to form open-closed waveguides 38 and 40. The acoustic drivers may be positioned and mounted to the extruded portion in holes at pre-determined points. The backplate 56 and the endplates may be attached to the extruded portion to form waveguide 14. The assembly of FIG. 11 permits easy insertion of, and mechanical fastening of, the acoustic drivers to the extruded portion. Damping material 66 may be inserted to attenuate high frequency peaks.

Though the elements of several views of the drawing may be shown and described as discrete elements in a block diagram and maybe referred to as "circuitry", unless otherwise indicated, the elements may be implemented as one of, or a combination of, analog circuitry, digital circuitry, or one or more microprocessors executing software instructions. The software instructions may include digital signal processing (DSP) instructions. Unless otherwise indicated, signal lines may be implemented as discrete analog or digital signal lines, as a single discrete digital signal line with appropriate signal processing to process separate streams of audio signals, or as elements of a wireless communication system. Some of the processing operations may be expressed in terms of the calculation and application of coefficients. The equivalent of calculating and applying coefficients can be performed by other analog or digital signal processing techniques and are included within the scope of this patent application. Unless otherwise indicated, audio signals or video signals or both maybe encoded and transmitted in either digital or analog form; conventional digital-to-analog or analog-to-digital converters may be omitted in the figures. For simplicity of wording "radiating acoustic energy corresponding to the audio signals in channel x" is referred to as "radiating channel x" In this specification, "frequency" and "wavelength" may be used interchangeably, since $$\lambda = \frac{c}{f} \text{ and } f = \frac{c}{\lambda},$$

where f is the frequency of a sound wave, λ is the wavelength of a sound wave, and c is the speed of sound, which for the purposes of this specification is a constant. So, for example "a wavelength of 100 Hz." means "the wavelength corresponding to a frequency of 100 Hz" and "a frequency of four times the length of the waveguide." means "the frequency corresponding to a wavelength of four times the length of the waveguide." Unless otherwise stated, the curves in the figures are computer simulations.

Other embodiments are in the claims.

What is claimed is:

1. Apparatus comprising:

an acoustic waveguide characterized by modes;

a plurality of acoustic drivers each characterized by a diameter, the acoustic drivers mounted in the waveguide so that at least two of the acoustic drivers are mounted at least a diameter apart, and so that the acoustic drivers radiate into the waveguide so that radiation from each acoustic driver excites one mode at a position in the waveguide at which a modal function corresponding with the one mode is non-zero and so that the total excitation of the one mode is substantially zero wherein the acoustic waveguide is an open-closed acoustic waveguide; and wherein the acoustic drivers are positioned according to the formula $$MF_{\frac{n\lambda}{4}} = \sin\left(\frac{n\pi}{4l}x_1\right) + \sin\left(\frac{n\pi}{4l}x_2\right) + \sin\left(\frac{n\pi}{4l}x_3\right) \ldots + \sin\left(\frac{n\pi}{4l}x_a\right) = 0,$$

where n is an odd number 3, 5, 7. . . , a is the number of acoustic drivers, l is the effective length of the waveguide, and $x_l \ldots x_a$ indicate the proportional distance from the open end the waveguide.

2. Apparatus comprising:

an acoustic waveguide characterized by modes;

a plurality of acoustic drivers each characterized by a diameter, the acoustic drivers mounted in the waveguide so that at least two of the acoustic drivers are mounted at least a diameter apart, and so that the acoustic drivers radiate into the waveguide so that radiation from each acoustic driver excites one mode at a position in the waveguide at which a modal function corresponding with the one mode is non-zero, and so that the total excitation of the one mode is substantially zero, wherein the acoustic waveguide is an open-open waveguide; and wherein the acoustic drivers are positioned according to the formula $$MF_{\frac{n\lambda}{2}} = \sin\left(\frac{n\pi}{2l}x_1\right) + \sin\left(\frac{n\pi}{2l}x_2\right) + \sin\left(\frac{n\pi}{2l}x_3\right) \ldots + \sin\left(\frac{n\pi}{2l}x_a\right) = 0,$$

where n is an integer greater than one, a is the number of acoustic drivers, l is the effective length of the waveguide, measured from an end, and $x_l \ldots x_a$ indicate the proportional distance from an end of the waveguide.

3. Apparatus comprising:

an acoustic waveguide characterized by modes:

a plurality of acoustic drivers each characterized by a diameter, the acoustic drivers mounted in the waveguide so that at least two of the acoustic drivers are mounted at least a diameter apart, and so that the acoustic drivers radiate into the waveguide so that radiation from each acoustic driver excites one mode at a position in the waveguide at which a modal function corresponding with the one mode is non-zero and so that the total excitation of the one mode is substantially zero, and further comprising circuitry for applying a different gain to the audio signal transmitted to at least two of the acoustic drivers.

4. Apparatus according to claim 3, wherein the circuitry transmits a common audio signal to the plurality of acoustic drivers.

5. Apparatus according to claim 4, wherein the acoustic waveguide is an open-closed waveguide and wherein the acoustic drivers are placed and the gains selected according to the formula $$MF_{\frac{n\lambda}{4}} = G_1\sin\left(\frac{n\pi}{4l}x_1\right) + G_2\sin\left(\frac{n\pi}{4l}x_2\right) + G_3\sin\left(\frac{n\pi}{4l}x_3\right)\ldots + G_a\sin\left(\frac{n\pi}{4l}x_a\right),$$

where n is an odd number 3, 5, 7. . . , a is the number of acoustic drivers, l is the effective length of the waveguide, $x_1 \ldots x_a$ indicate the proportional distance from the open end the waveguide, and G is the gain applied to the corresponding acoustic driver.

6. Apparatus according to claim 4, wherein the acoustic waveguide is an open-open waveguide and wherein the acoustic drivers are placed and the gains selected according to the formula $$MF_{\frac{n\lambda}{2}} = G_1\sin\left(\frac{n\pi}{2l}x_1\right) + G_2\sin\left(\frac{n\pi}{2l}x_2\right) + G_3\sin\left(\frac{n\pi}{2l}x_3\right)\ldots + G_a\sin\left(\frac{n\pi}{2l}x_a\right)$$

where n is an integer greater than one, a is the number of acoustic drivers, l is the effective length of the waveguide, measured from an end, $x_1 \ldots x_a$ indicate the proportional distance from an end of the waveguide and G is the gain applied to the corresponding acoustic driver.

7. Apparatus comprising:

an acoustic waveguide characterized by modes;

a plurality of acoustic drivers each characterized by a diameter, the acoustic drivers mounted in the waveguide so that at least two of the acoustic drivers are mounted at least a diameter apart, and so that the acoustic drivers radiate into the waveguide so that radiation from each acoustic driver excites one mode at a position in the waveguide at which a modal function corresponding with the one mode is non-zero, and so that the total excitation of the one mode is substantially zero, wherein the waveguide is a conical waveguide and wherein the acoustic drivers are positioned according to the formula $$MF_n = \frac{\sin\left(\frac{2\pi}{c}f_n(x_1-d)\right)}{\frac{2\pi}{c}f_n(x_1+d)} + \tan\frac{\left(\frac{2\pi}{c}f_nL\right)\cos\left(\frac{2\pi}{c}f_n(x_1+d)\right)}{\sqrt{\frac{A_C}{A_O}-1}\ \frac{2\pi}{c}f_n(x_1+d)} + \frac{\sin\left(\frac{2\pi}{c}f_n(x_2-d)\right)}{\frac{2\pi}{c}f_n(x_2+d)} + \tan\frac{\left(\frac{2\pi}{c}f_nL\right)\cos\left(\frac{2\pi}{c}f_n(x_2+d)\right)}{\sqrt{\frac{A_C}{A_O}-1}\ \frac{2\pi}{c}f_n(x_2+d)} + \ldots\frac{\sin\left(\frac{2\pi}{c}f_n(x_a+d)\right)}{\frac{2\pi}{c}f_n(x_a+d)} + \tan\frac{\left(\frac{2\pi}{c}f_nL\right)\cos\left(\frac{2\pi}{c}f_n(x_a+d)\right)}{\sqrt{\frac{A_C}{A_O}-1}\ \frac{2\pi}{c}f_n(x_a+d)} = 0$$

for each mode, where L represents the effective length of the waveguide, $f_n$ represents the frequency corresponding with the mode, $A_o$ represents the cross-sectional area at the open end, $A_c$, represents the cross-sectional area at the closed end, x represents the proportional position from the open end, and d is given by $$d = \frac{L}{\sqrt{\frac{A_C}{A_O}-1}},$$

and a is the number of acoustic drivers.

8. A method comprising:

radiating, by a plurality of acoustic drivers, at least two of the acoustic drivers placed more than a diameter apart into an acoustic waveguide at positions at which the model function corresponding with one mode is non-zero and so that the total excitation of the one mode is substantially zero, wherein the waveguide is an open-closed waveguide and wherein in the radiating comprises radiating into the waveguide at positions according the formula $$MF_{\frac{n\lambda}{4}} = \sin\left(\frac{n\pi}{4l}x_1\right) + \sin\left(\frac{n\pi}{4l}x_2\right) + \sin\left(\frac{n\pi}{4l}x_3\right)\ldots + \sin\left(\frac{n\pi}{4l}x_a\right) = 0$$

where n is an odd integer greater than one indicating modes not to be excited, a is the number of acoustic drivers, l is the effective length of the waveguide, measured from the open end, and $x_1 \ldots x_a$ indicate the proportional position along the waveguide.

9. A method comprising:

radiating, a plurality of acoustic drivers, at least two of the acoustic drivers placed more than a diameter apart into an acoustic waveguide at positions at which the modal function corresponding with one mode is non-zero and so that the total excitation of the one mode is substantially zero, wherein the waveguide is an open-open waveguide and wherein the radiating comprises radiating into the waveguide at positions according to the formula $$MF_{\frac{n\lambda}{2}} = \sin\left(\frac{n\pi}{2l}x_1\right) + \sin\left(\frac{n\pi}{2l}x_2\right) + \sin\left(\frac{n\pi}{2l}x_3\right)\ldots + \sin\left(\frac{n\pi}{2l}x_a\right) = 0$$

where n is an integer greater than one, a is the number of acoustic drivers, l is the effective length of the waveguide, measured from an end, and $x_1 \ldots x_a$ indicate the proportional position along the waveguide.

10. A method comprising:

radiating, by a plurality of acoustic drivers, at least two of the acoustic drivers placed more than a diameter apart into an acoustic waveguide at positions at which the modal function corresponding with one mode is non-zero and so that the total excitation of the one mode is substantially zero, and further comprising providing each acoustic driver with an audio signal;

applying a different gain to the audio signal to at least two of the acoustic drivers.

11. A method comprising:

radiating, by a plurality of acoustic drivers, at least two of the acoustic drivers placed more than a diameter apart into an acoustic waveguide at positions at which the modal function corresponding with one mode is non-zero and so that the total excitation of the one mode is substantially zero, wherein the waveguide is a conical waveguide and wherein the radiating comprises radiating into the waveguide at positions according to the formula $$MF_n = \frac{\sin\left(\frac{2\pi}{c} f_n(x_1 + d)\right)}{\frac{2\pi}{c} f_n(x_1 + d)} + \tan\frac{\left(\frac{2\pi}{c} f_n L\right)\cos\left(\frac{2\pi}{c} f_n(x_1 + d)\right)}{\sqrt{\frac{A_C}{A_O} - 1}\ \frac{2\pi}{c} f_n(x_1 + d)} +$$

$$\frac{\sin\left(\frac{2\pi}{c} f_n(x_2 + d)\right)}{\frac{2\pi}{c} f_n(x_2 + d)} + \tan\frac{\left(\frac{2\pi}{c} f_n L\right)\cos\left(\frac{2\pi}{c} f_n(x_2 + d)\right)}{\sqrt{\frac{A_C}{A_O} - 1}\ \frac{2\pi}{c} f_n(x_2 + d)} +$$

$$\ldots\frac{\sin\left(\frac{2\pi}{c} f_n(x_n + d)\right)}{\frac{2\pi}{c} f_n(x_n + d)} + \tan\frac{\left(\frac{2\pi}{c} f_n L\right)\cos\left(\frac{2\pi}{c} f_n(x_a + d)\right)}{\sqrt{\frac{A_C}{A_O} - 1}\ \frac{2\pi}{c} f_n(x_a + d)} = 0$$

for each mode, where L represents the effective length of the waveguide, $f_n$ represents the frequency corresponding with the mode, $A_o$ represents the cross-sectional area at the open end, $A_c$ represents the cross-sectional area at the closed end, x represents the proportional position from the closed end, and d is given by $$d = \frac{L}{\sqrt{\frac{A_C}{A_O} - 1}},$$

and a is the number of acoustic drivers.

* * * * *